US007920041B2

(12) United States Patent
Rokuka et al.

(10) Patent No.: US 7,920,041 B2
(45) Date of Patent: Apr. 5, 2011

(54) COIL DEVICE FOR ANTENNA AND ANTENNA SYSTEM FOR REAR WINDOW OF VEHICLE

(75) Inventors: Takanobu Rokuka, Chuo-ku (JP); Shigeru Mahara, Chuo-ku (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 12/302,771

(22) PCT Filed: Mar. 14, 2007

(86) PCT No.: PCT/JP2007/055101

§ 371 (c)(1),
(2), (4) Date: Nov. 26, 2008

(87) PCT Pub. No.: WO2007/138775

PCT Pub. Date: Dec. 6, 2007

(65) Prior Publication Data

US 2009/0195341 A1 Aug. 6, 2009

(30) Foreign Application Priority Data

May 29, 2006 (JP) ..... 2006-148417

(51) Int. Cl.

| | |
|---|---|
| ***H01F 27/29*** | (2006.01) |
| ***H01F 27/06*** | (2006.01) |
| ***H01F 27/02*** | (2006.01) |
| ***H01F 27/30*** | (2006.01) |
| ***H01Q 1/12*** | (2006.01) |
| ***H01Q 7/08*** | (2006.01) |

(52) U.S. Cl. ..... 336/192; 336/65; 336/83; 336/90; 336/197; 336/198; 343/718; 343/788

(58) Field of Classification Search ..... 366/65–67, 366/197–198; 336/65–67, 197–198, 83, 336/90, 192; 343/718, 788

See application file for complete search history.

(56) References Cited

U.S. PATENT DOCUMENTS

2005/0052337 A1* 3/2005 Fujii et al. ..... 343/895
2005/0219139 A1* 10/2005 Kimura et al. ..... 343/788

FOREIGN PATENT DOCUMENTS

| | | |
|---|---|---|
| JP | 2-36204 | 3/1990 |
| JP | 6-15322 | 2/1994 |
| JP | 09-213528 | 8/1997 |
| JP | 2005-086402 | 3/2005 |

OTHER PUBLICATIONS

JP 09-213528 A Translation.*

English translation of JP 06-015322 U.*

English translation of JP 09-213528, Takahashi, Choke Coil, Aug. 15, 1997.*

English translation of JP 06-015322 U, Yamamoto, Terminal device for antenna coil for use on windowpane of vehicle, Feb. 25, 1994.*

* cited by examiner

*Primary Examiner* — Lincoln Donovan
*Assistant Examiner* — Tszfung Chan
(74) *Attorney, Agent, or Firm* — Stevens Law Group; David R. Stevens

(57) ABSTRACT

In a coil device for an antenna, a wide surface of a connector connecting section and a mounting surface of a fixing section are substantially vertically arranged. A connecter terminal can take a first arrangement or a second arrangement to a resin member. In the first arrangement the connector terminal can take, the connector connecting section is positioned on one end side in the width direction of the resin member, and in the second arrangement, the connector connecting section is positioned on the other end side in the width direction of the resin member by turning the connector connecting section in the first arrangement 180 degrees.

3 Claims, 8 Drawing Sheets

*FIG. 9*

PRIOR ART

| | RESONANT FREQUENCY [MHz] | L [μH] | C [pF] |
|---|---|---|---|
| CONVENTIONAL COIL DEVICE FOR ANTENNA (1) | 81.0 | 2.50 | 1.54 |
| CONVENTIONAL COIL DEVICE FOR ANTENNA (2) | 77.3 | 2.50 | 1.70 |
| COIL DEVICE FOR ANTENNA ACCORDING TO THIRD EMBODIMENT | 91.2 | 2.50 | 1.22 |

COIL DEVICE FOR ANTENNA AND ANTENNA SYSTEM FOR REAR WINDOW OF VEHICLE

TECHNICAL FIELD

The present invention relates to a coil device for antenna suitably used for removing noise superimposed on radio wave signals, for example, and an antenna system for a rear window of a vehicle.

BACKGROUND ART

Conventionally, there has been provided a vehicular glass antenna capable of receiving radio broadcast signals, TV broadcast signals and the like in a vehicle, the vehicular glass antenna being formed by arranging antenna wires on a rear window of the vehicle. Specifically, heater wires of a defogger and the antenna wires formed on peripheral portions of the heater wires are arranged on the rear window of the vehicle. The heater wires and the antenna wires arranged on the rear window serve as a receiving antenna, so that the radio broadcast signals, the TV broadcast signals and the like can be received.

Noise components may be mixed into the radio wave signals of the radio broadcast, the TV broadcast and the like received by the vehicular glass antenna. One of the reasons for the mixing of the noise components into the radio wave signals is the influence of noise contained in the electric power output from a vehicle-mounted battery for heating the heater wires of the defogger. Inversely, the radio wave signals received by the heater wires of the defogger may also be leaked into the vehicle body through an electric supply line.

For this reason, a coil device for antenna for removing noise is connected between the heater wires for preventing the rear window of the vehicle from fog and a DC power supply such as the vehicle-mounted battery. The coil device for antenna uses self-resonant frequency thereof to prevent superimposition of the noise on the radio wave signals received by the vehicular glass antenna and to improve sensitivity for receiving the radio wave signals. Further, in response to the frequency band of the signal wave, high impedance is generated near the resonant frequency to remove the noise superimposed on the radio wave signals.

Ends of the heater wires arranged on the rear window of the vehicle are gathered by a bus bar. Further, impedance is set to a high value between the bus bar and the vehicle body or between the bus bar and the DC power supply, so that the leakage current is restrained. Further, since the radio wave signals received by the antenna need to be prevented from being leaked into the vehicle body through the electric supply line of the defogger, the coil held by a resin member is connected and fixed to the bus bar by means of soldering or the like.

Patent Document 1 discloses a choke coil 10 for reducing noise. A configuration example of the choke coil 10 for the glass antenna will be described below with reference to FIG. 10. In the choke coil 10, a cylindrical Ni—Zn group magnetic core 2 is inserted into a coil 1 formed by winding a copper wire in layers into a tubular shape. Further, both ends of the coil 1 are respectively connected to a metal terminal plate 5 and a metal plate 6 provided on a plastic fixing base constituted by a base portion 3 and a base auxiliary portion 4. A dielectric 7 is inserted between the metal terminal plate 5 and the metal plate 6.

Patent Document 2 discloses a coil device for antenna for removing noise. A configuration example of a coil device for antenna 20 connected to the bus bar will be described below with reference to FIG. 11. In the coil device for antenna 20, a coil portion 12 with a lead wire wound around a magnetic core 11 is mounted on a plastic resin case 13. A terminal board 14 for connecting one end of the lead wire wound around the coil portion 12 thereto is provided on the front side of the case 13. Similarly, a terminal board 15 for connecting the other end of the lead wire wound around the coil portion 12 thereto is provided on the front side of the case 13. The terminal boards 14, 15 face each other in parallel, separated from each other by a prescribed distance in vertical direction.

[Patent Document 1] Japanese Unexamined Patent Application Publication No. H09-213528

[Patent Document 2] Japanese Unexamined Patent Application Publication No. 2005-086402

DISCLOSURE OF THE INVENTION

The conventional coil device for antenna attached to the rear window of the vehicle is configured by two sets of components corresponding to two different specifications depending on whether the coil device for antenna is attached to the right end portion or to the left end portion of the rear window. In order to produce these components, two kinds of dies and production lines corresponding to two different specifications have to be prepared, which becomes a factor to increase the production cost. Further, since two sets of components corresponding to two different specifications have to be produced, the number of the components is increased, and the increased components have to be managed. As a result, the assembling work can not be easily performed.

Since the choke coil 10 disclosed in Patent Document 1 has no bilaterally symmetrical structure, a plurality of kinds of choke coils corresponding to different specifications have to be prepared according to the mounting position of the choke coil. Thus, there have arisen the aforesaid problems.

In the coil device for antenna disclosed in Patent Document 2, the two opposed terminal boards and the case each have bilaterally symmetrical structure. However, since the shape of the coil pattern of the coil portion mounted on the case is limited, it is hard to say that the coil device for antenna disclosed in Patent Document 2 has high degree of freedom in design.

The present invention has been made in view of the aforesaid problems, and an object of the present invention is to provide a coil device for antenna configured by a set of components corresponding to one single specification but capable of coping with a plurality of specifications, and having high degree of freedom in design.

A coil device for antenna according to an aspect of the present invention includes: a winding coil; a bar-like magnetic core inserted into the winding coil; a connector terminal provided with a connector connecting section and a first engaging portion for engaging one end of the winding coil thereto; a mounting terminal provided with a fixing section having a mounting surface, and a second engaging portion for engaging the other end of the winding coil thereto; and a resin member to which the mounting terminal and the connector terminal are attached and on which the winding coil is mounted. Further, a wide surface of the connector connecting section is perpendicular to the mounting surface of the fixing section, and the connector terminal can take a first arrangement or a second arrangement to the resin member, in which, in the first arrangement, the connector connecting section is positioned on one end side in the width direction of the resin member, and in the second arrangement, the connector connecting section is positioned on the other end side in the width direction of the resin member by turning the connector connecting section in the first arrangement 180 degrees.

In the coil device for antenna, since the connector terminal can take the first arrangement or the second arrangement to the resin member, it is possible to configure a coil device for antenna capable of coping with a plurality of specifications with a set of components corresponding to one single specification.

According to the present invention, since the coil device for antenna capable of coping with a plurality of specifications is configured with a set of components corresponding to one single specification, it is not necessary to produce a plurality of sets of components according to the mounting position, and therefore the production cost can be reduced. Further, by preparing a plurality of coil patterns of the wire forming the coil portion, high degree of freedom in design can be achieved.

BRIEF DESCRIPTION OF DRAWINGS

FIG. 9 is a table showing an example of stray capacitance of the coil device for antenna according to the third embodiment of the present invention and stray capacitance of the coil devices for antenna according to conventional arts.

BEST MODES FOR CARRYING OUT THE INVENTION

Figure 1:
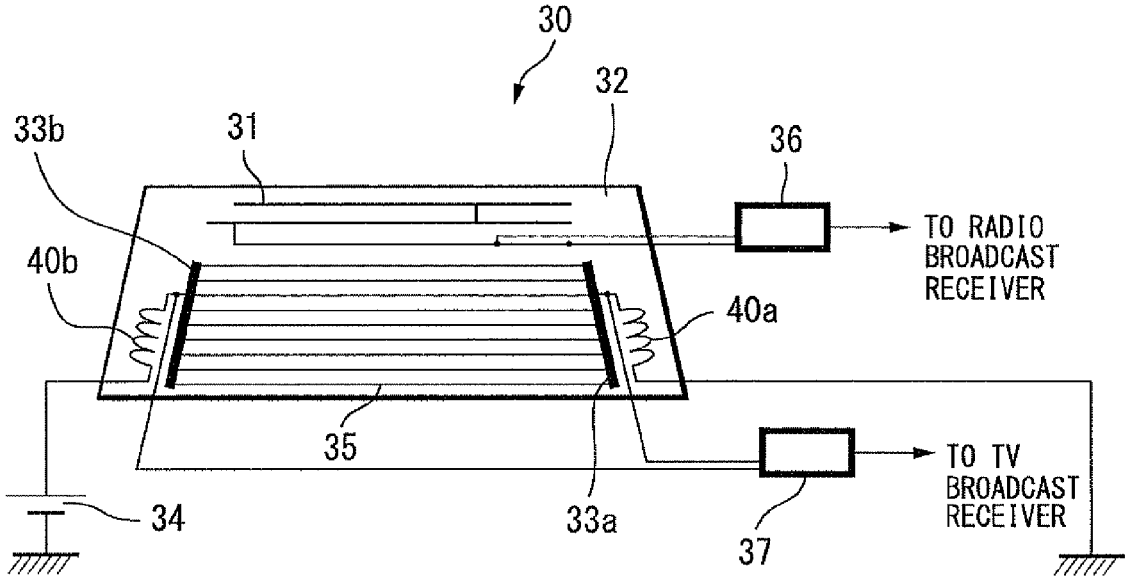
FIG. 1 is a view showing a configuration example of a coil device for antenna according to a first embodiment of the present invention.

A coil device for antenna according to a first embodiment will be described below with reference to FIGS. 1 to 6. The first embodiment is described using an example in which the present invention is applied to a coil device for antenna capable of removing noise superimposed on radio wave signals of radio broadcast, TV broadcast and the like.

An example of connection structure of an antenna system mounted on a rear window of a vehicle will be described below with reference to FIG. 1, in which the coil device for antenna according to the present invention is mounted on the rear window of the vehicle.

A receiving system 30 for receiving the radio broadcast and TV broadcast is configured on a rear window 32 of a vehicle (not shown). A radio antenna wire 31 for receiving the radio broadcast and a plurality of TV antenna wires 35 for receiving the TV broadcast are embedded in the rear window 32. An amplifier 36 for amplifying the radio broadcast signal received by the radio antenna wire 31 is connected to the radio antenna wire 31. The radio wave signal amplified by the amplifier 36 is supplied to a radio broadcast receiver (not shown).

The vehicle is provided with a vehicle-mounted battery 34 for supplying DC power. The TV antenna wires 35 also serves as electric supply lines of a defogger provided to prevent fog on the rear window 32. The electric supply lines of the defogger are heated by the electric power supplied by the vehicle-mounted battery 34, so that the whole rear window 32 is warmed, and therefore the fog on the rear window 32 is prevented. Two coil devices for antenna 40*a*, 40*b* for removing the noise are arranged at both right and left end portions of the rear window 32.

The vehicle-mounted battery 34 is connected to a bus bar 33*b* through the coil device for antenna 40*b*. The bus bar 33*b* is connected to one end of each of the TV antenna wires 35. The bus bar 33*b* has a function of equally distributing the electric power of the vehicle-mounted battery 34 to the plurality of TV antenna wire 35. A bus bar 33*a* is connected to the other end of each of the TV antenna wires 35. The coil device for antenna 40*a* for removing the noise is connected to the bus bar 33*a*.

An amplifier 37 for amplifying the TV broadcast signal received by the TV antenna wire 35 is connected to the TV antenna wire 35. The amplifier 37 is connected to the bus bar 33*a* and the bus bar 33*b*. The TV broadcast signal amplified by the amplifier 37 is supplied to a TV receiver (not shown).

Figure 2:
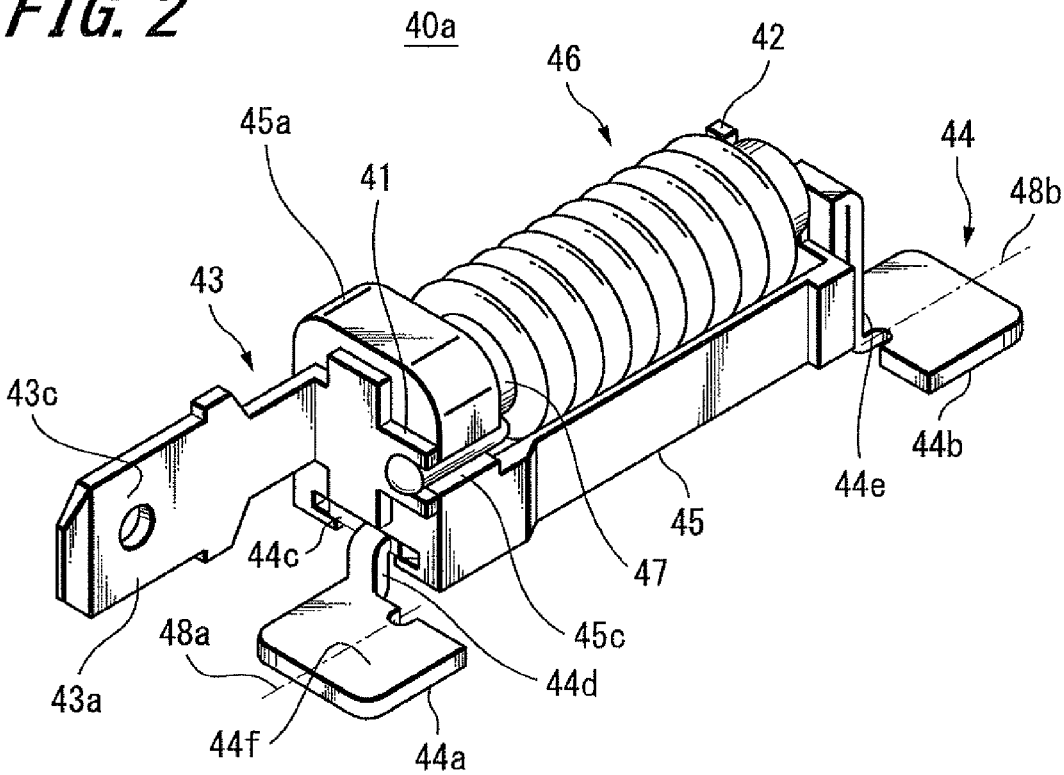
FIG. 2 is a perspective view showing an example of the coil device for antenna according to the first embodiment of the present invention.

A configuration example of the coil device for antenna 40*a* according to the present embodiment will be described below with reference to FIG. 2.

The coil device for antenna 40*a* is provided with a conductive mounting terminal 44 for mounting the coil device for antenna 40*a* to the right end portion of the rear window 32 (see FIG. 1). The mounting terminal 44 is a terminal formed by punching and bending a flat conductive plate. The mounting terminal 44 is formed with a flat plate-like main body 44*c*. A base 45 formed of a non-conductive and non-magnetic resin is attached to the main body 44*c*. The main body 44*c* is formed with, at both end portions thereof, a first support portion 44*d* and a second support portion 44*e*. The first support portion 44*d* and the second support portion 44*e* are formed by being bent substantially perpendicularly with respect to the main body 44*c* so that the first support portion 44*d* and the second support portion 44*e* extend in the same direction.

A first mounting portion 44*a* to be contacted to the mounting position of the rear window 32 is connected to the main body 44*c* through the first support portion 44*d*. The first mounting portion 44*a* is formed by being bent substantially perpendicularly with respect to the first support portion 44*d*. Thus, a crank shape is formed in which a flat surface of the first mounting portion 44*a* is located on the outside of a flat surface of the main body 44*c*, so that the flat surface of the first mounting portion 44*a* and the flat surface of the main body 44*c* extend substantially in the same direction. The first support portion 44*d* according to the present embodiment is connected to the first mounting portion 44*a* at a position shifted from a center line 48*a* of the first mounting portion 44*a*.

A second mounting portion 44*b* to be contacted to the mounting position of the rear window 32 is connected to the main body 44*c* through the second support portion 44*e*. The second mounting portion 44*b* is formed by being bent substantially perpendicularly with respect to the second support portion 44*e*. Thus, a crank shape is formed in which a flat surface of the second mounting portion 44*b* is located on the outside of a flat surface of the main body 44*c*, so that the flat surface of the second mounting portion 44*b* and the flat surface of the main body 44*c* extend substantially in the same direction. The second support portion 44*e* according to the present embodiment is connected to the second mounting portion 44*b* at a position shifted from the center line 48*b* of the second mounting portion 44*b*. A second engaging portion 42 for engaging the wire thereto is formed on the same side of the second support portion 44*e*. Note that, the first mounting portion 44*a* and the second mounting portion 44*b* are each provided with a flat surface for mounting the coil device for antenna to the mounting position of the rear window 32, and the flat surface is also called as a "mounting surface".

The base 45 is fixed to the main body 44*c* of the mounting terminal 44 with an adhesive or the like. A coil portion 46 is fixed to the base 45 with an adhesive or the like, the coil portion 46 being formed by winding a wire around a cylindrical magnetic core 47 for a predetermined turns. The magnetic core 47 is a bar-like or polygonal-prism-shaped magnetic core. The base 45 has a connector terminal connecting portion 45*a* formed at one end thereof, the connector terminal connecting portion 45*a* being provided for connecting a conductive connector terminal 43 thereto. The connector terminal connecting portion 45*a* is formed as a projection at an end portion of the base 45 on the side to which the connector terminal 43 is attached. Further, the connector terminal connecting portion 45*a* is formed with a first groove 45*c*, the depth and width of which are substantially equal to the diameter of the wire wound around the coil portion 46. The connector terminal 43 is fixed to the connector terminal connecting portion 45*a* with an adhesive or the like. The connector terminal 43 is formed with a connector connecting section 43*a* for connecting a wire of an external device thereto. The connector connecting section 43*a* is arranged so that a wide surface 43*c* thereof is perpendicular to a wide surface 44*f* of the first mounting portion 44*a*.

One end of the wire wound around the coil portion 46 is engaged to a first engaging portion 41 formed in the connector terminal 43 through the first groove 45*c*. The other end of the wire wound around the coil portion 46 is engaged to a second engaging portion 42 formed by bending the mounting terminal 44. In the present embodiment, the arrangement shown in FIG. 2 in which the connector terminal 43 is connected to the connector terminal connecting portion 45*a* is called as a "first arrangement".

Figure 3:
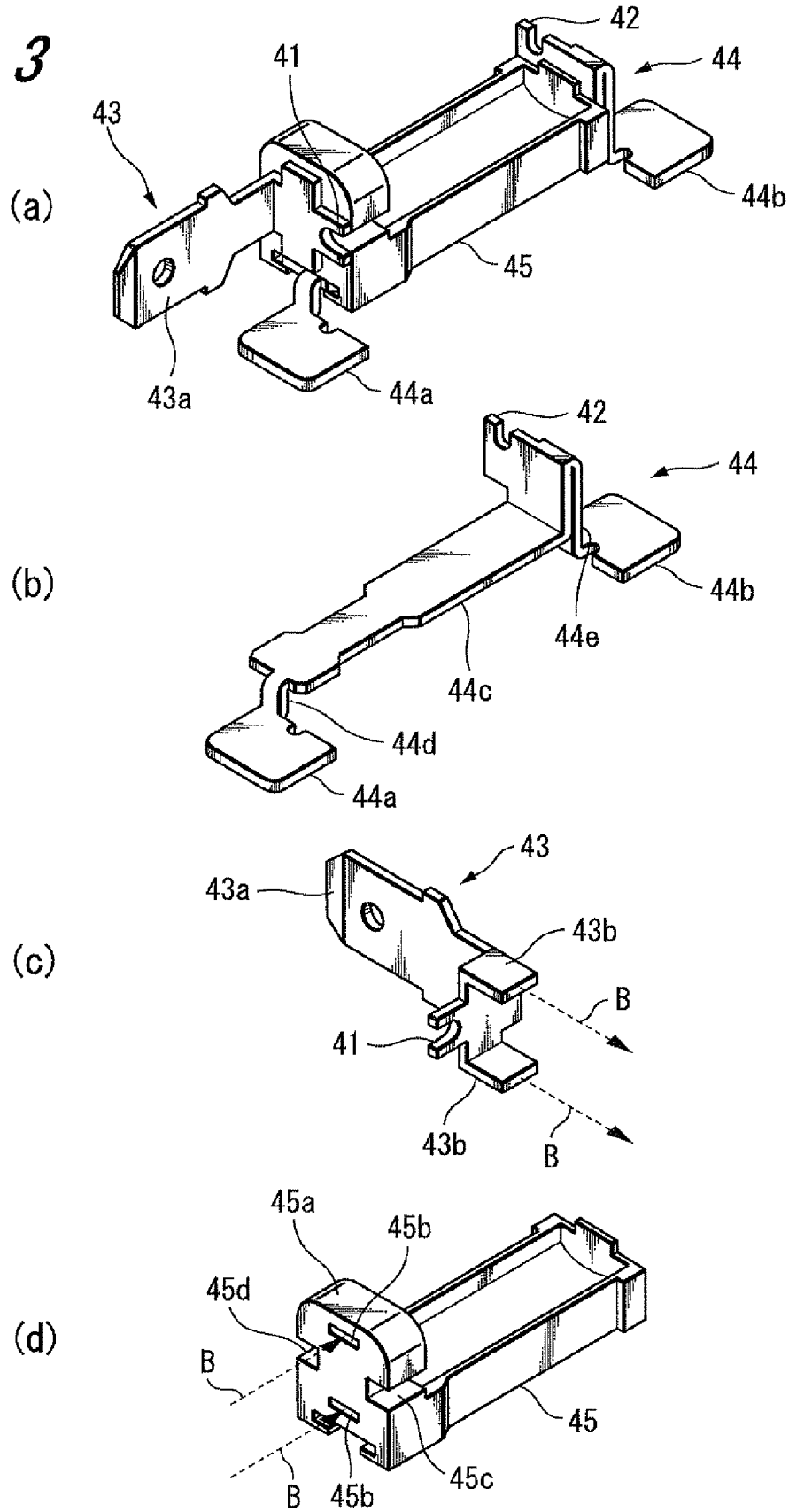
FIG. 3 is a partial assembly drawing showing an example of every portion constituting the coil device for antenna according to the first embodiment of the present invention.

An example in which the coil device for antenna 40*a* according to the present embodiment is broken down into its parts will be described below with reference to FIG. 3. In FIG. 3, like components are denoted by like numerals as of FIG. 2 and the detailed explanation thereof will be omitted.

FIG. 3(*a*) is a perspective view showing the coil device for antenna 40*a* with the coil portion 46 detached therefrom, namely, FIG. 3(*a*) shows a structure including only the connector terminal 43, the mounting terminal 44 and the base 45. FIG. 3(*b*) is a perspective view showing a configuration example of the mounting terminal 44. FIG. 3(*c*) is a perspective view showing a configuration example of the connector terminal 43. FIG. 3(*d*) is a perspective view showing a configuration example of the base 45.

As can be known from FIG. 3(*a*), the base 45 is formed with a recess for attaching the coil portion 46 (see FIG. 2) thereto. Other structured of the base 45 are identical to that shown in FIG. 2.

As can be known from FIG. 3(*b*), the mounting terminal 44 is formed by one single conductive material. Specifically, the mounting terminal 44 is formed by punching a flat plate-like conductive material and then bending the punched material.

As can be known from FIG. 3(*c*), the connector terminal 43 is formed with the base connecting portion 43*b* for being connected to the base 45. The base 45 is formed with the connector terminal connecting portion 45*a* (see FIG. 3(*d*)) to be inserted into a base connecting portion insertion hole 45*b* (which will be described later) along an arrow B, which represents a connecting direction in which the connector terminal is connected. The base connecting portion 43*b* (connector terminal 43) can be inserted into the base connecting portion insertion hole 45*b* along the arrow B and fixed with an adhesive or the like. In the present embodiment, the connector terminal 43 can be connected to the base 45 having the direction thereof changed by 180 degrees.

As can be known from FIG. 3(*d*), the connector terminal connecting portion 45*a* is formed with the base connecting portion insertion hole 45*b* for connecting the connector terminal 43 thereto. Further, the connector terminal connecting portion 45*a* is formed with a second groove 45*d* in a position bilaterally symmetrical to the first groove 45*c*. Similar to the first groove 45*c*, the depth and width of the second groove 45*d* are substantially equal to the diameter of the wire forming the coil portion 46.

Figure 4:
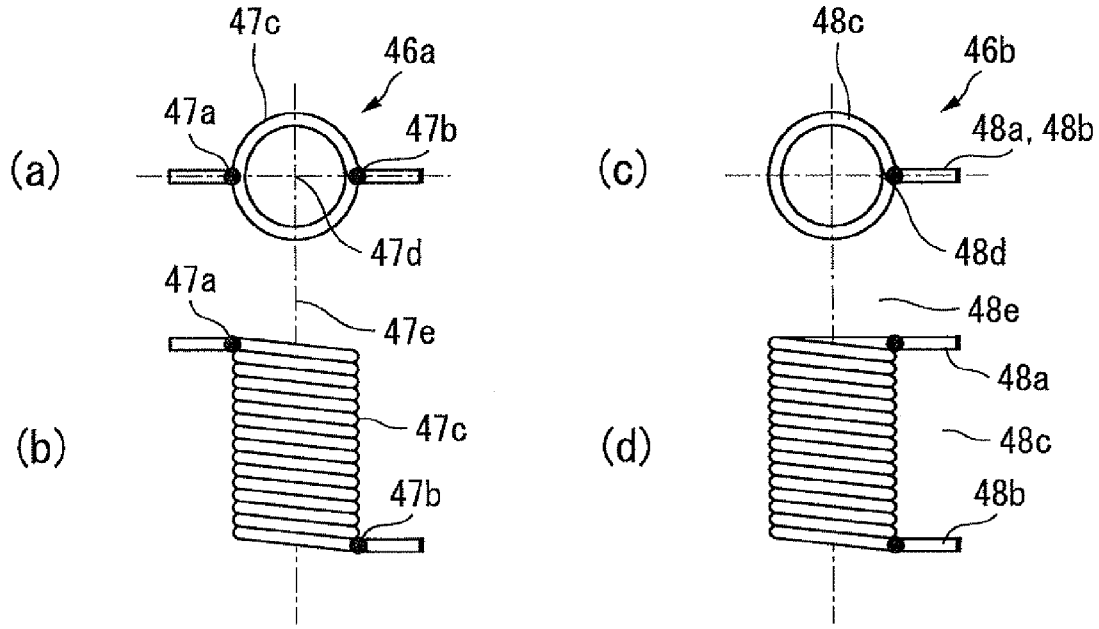
FIG. 4 is a view explaining an example of coil patterns according to the first embodiment of the present invention.

Examples of the coil pattern of the wire wound around the magnetic core 47 to form the coil portion 46 will be described below with reference to FIG. 4. FIG. 4(*a*) shows an example of a first coil pattern 46*a* when seen from the front side. FIG. 4(*b*) shows the example of the first coil pattern 46*a* when seen from the upper side. FIG. 4(*c*) shows an example of a second coil pattern 46*b* when seen from the front side. FIG. 4(*d*) shows the example of the second coil pattern 46*b* when seen from the upper side. Note that, in order to describe the first and second coil patterns, the description of the magnetic core 47 will be omitted.

As can be known from FIG. 4(*a*), a conductive wire 47*c* forming the first coil pattern 46*a* is wound from a winding start point 47*a* to a winding end point 47*b* for a predetermined turns at an equal pitch from a center point 47*d* of the magnetic core (not shown). The winding start point 47*a* and the winding end point 47*b* are located at positions substantially opposite to each other with the center point 47*d* interposed therebetween.

As can be known from FIG. 4(*b*), the first coil pattern 46*a* is a pattern in which the wire 47*c* is wound for n+(½) turns along a winding axis 47*e* coincident with the inserting direction of the magnetic core, the winding of the wire 47*c* being started from the winding start point 47*a* and ended at the winding end point 47*b*. The coil pattern in which the wire 47*c* is wound for n+(½) turns is deemed as the first coil pattern 46*a*. The first coil pattern 46*a* is used as the coil pattern of the coil device for antenna 40*a*.

As can be known from FIG. 4(*c*), a conductive wire 48*c* forming the second coil pattern 46*b* is wound from a winding start point 48*a* to a winding end point 48*b* for a predetermined turns at an equal pitch from a center point 48*d* of the magnetic core (not shown). The winding start point 47*a* and the winding end point 47*b* are located substantially at the same position when seen from the front side.

As can be known from FIG. 4(*d*), the second coil pattern 46*b* is a pattern in which the wire 48*c* is wound for n turns along a winding axis 48*e* coincident with the inserting direction of the magnetic core, the winding of the wire 48*c* being started from the winding start point 48*a* and ended at the winding end point 48*b*. The coil pattern in which the wire 48*c* is wound for n turns is deemed as the second coil pattern 46*b*.

In such a manner, two coil patterns having the same winding end point 47*b* and different winding start point are used as the coil pattern of the wire forming the coil portion 46 of the present embodiment. Thus, the first coil pattern 46*a* and the second coil pattern 46*b* differ from each other in that the turn numbers of the wires thereof are different from each other by (½) turn. Thus, the inductance L can be adjusted by changing the turn number of the wire half turn a time, or one turn a time. Incidentally, the turn number of the wire 47*c* of the first coil pattern 46*a* may also be n−(½) turns.

Figure 5:
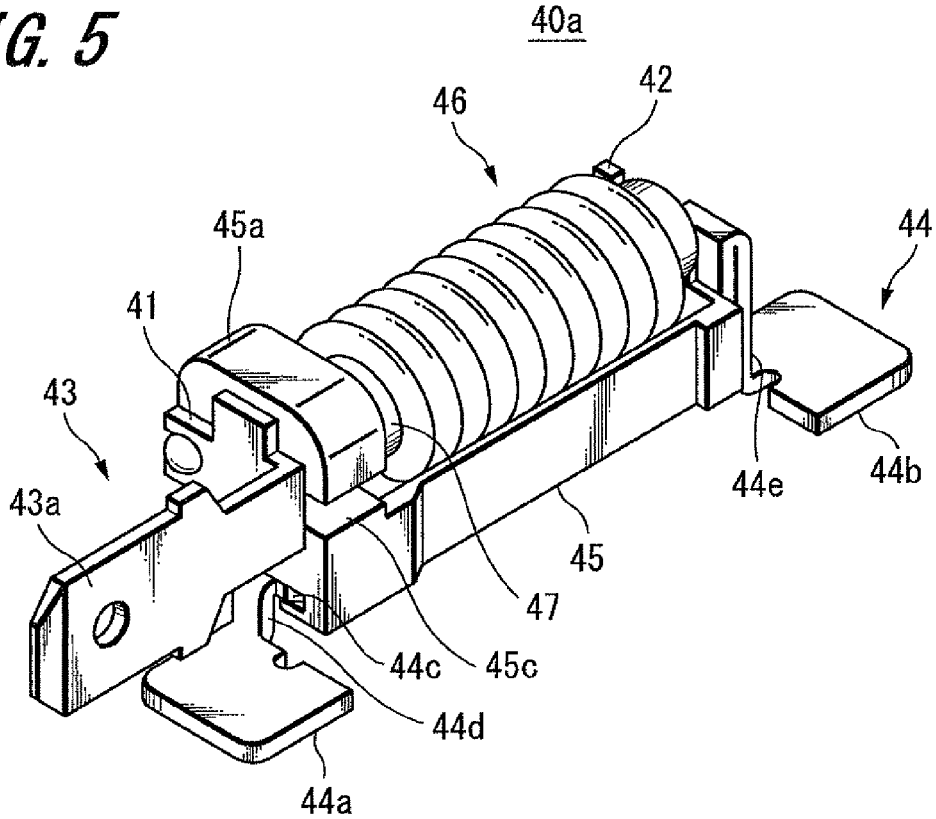
FIG. 5 is a perspective view showing an example of the first embodiment of the present invention in which a connector terminal is connected having the direction thereof changed.

A configuration example of the coil device for antenna 40*a* in which the connector terminal 43 is connected to the base 45 having the direction thereof changed by 180 degrees will be described below with reference to FIG. 5. Note that, since the configuration example of the connector terminal 43, the mounting terminal 44 and the base 45 is identical to that shown in FIG. 2, which has already been described above, like components are denoted by like numerals in the below description and the detailed explanation thereof will be omitted.

The connector terminal connecting portion 45*a* is formed with a first groove 45*c* and a second groove 45*d* (see FIG. 3(*d*)). In the case where the connector terminal 43 is connected to the base 45 having the direction thereof changed by 180 degrees, the second coil pattern 46*b* (see FIG. 4(*d*)) is used as the coil pattern forming the coil portion. A coil portion 46' is formed by a wire wound according to the second coil pattern 46*b*. At this time, the turn number of the wire wound around the coil portion 46' differs from the turn number of the wire wound around the coil portion 46 by half turn. In the present embodiment, the arrangement shown in FIG. 5 in which the connector terminal 43 is connected to the connector terminal connecting portion 45*a* is called as a "second arrangement". In such a manner, it is possible to configure the coil device for antenna 40*a* capable of taking the first arrangement or the second arrangement by turning the connector terminal 43 by 180 degrees.

Figure 6:
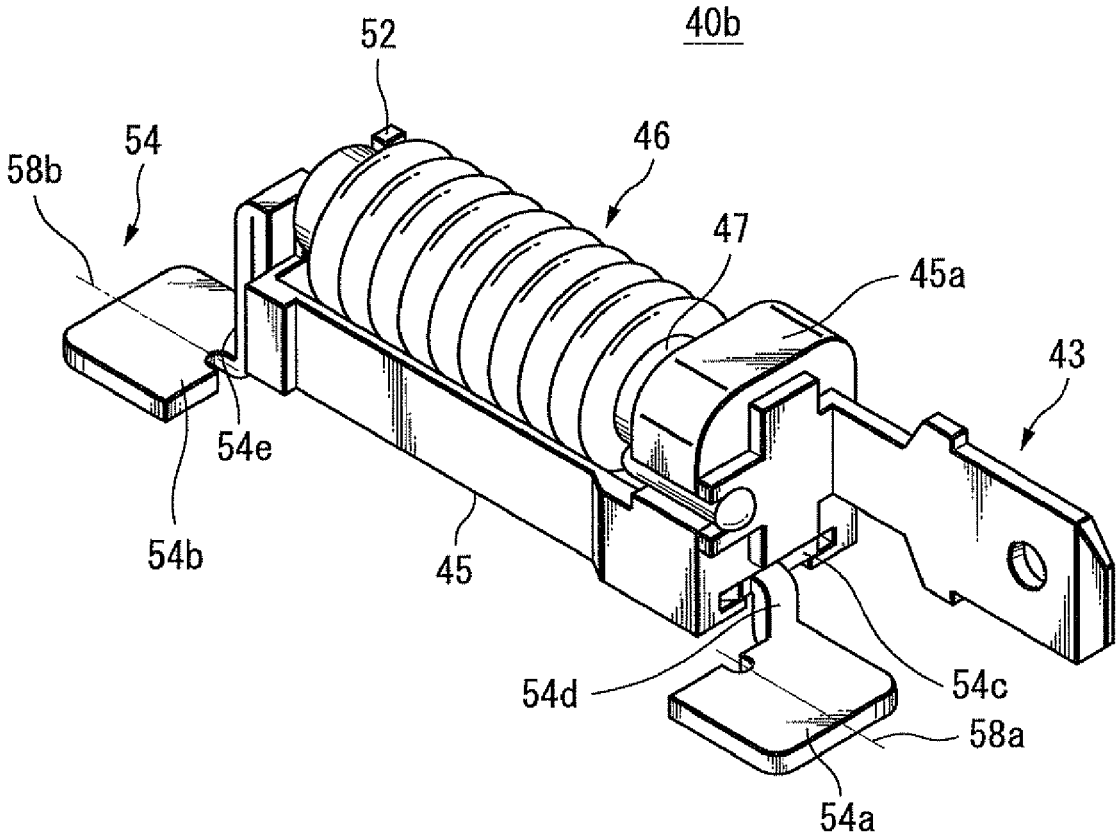
FIG. 6 is a perspective view showing another example of the coil device for antenna according to the first embodiment of the present invention.

A configuration example of the coil device for antenna 40*b* according to the present embodiment will be described below with reference to FIG. 6. The configuration of the coil device for antenna 40*a* has already described above, the coil device for antenna 40*b* has the same configuration of the coil device for antenna 40*a*. Note that, since the configuration example of the connector terminal 43, the base 45 and the coil portion 46 of the coil device for antenna 40*b* is identical to that of the coil device for antenna 40*a*, like components are denoted by like numerals in the below description and the detailed explanation thereof will be omitted.

The coil device for antenna 40*b* is provided with a conductive mounting terminal 54 for mounting the coil device for antenna 40*b* to the left end portion of the rear window 32 (see FIG. 1). The mounting terminal 54 is a terminal formed by punching and bending a flat conductive plate. The mounting terminal 54 is formed with a flat plate-like main body 54*c*. The base 45 formed of a non-conductive and non-magnetic resin is attached to the main body 54*c*. The main body 54*c* is formed with, at both end portions thereof, a first support portion 54*d* and a second support portion 54*e*. The first support portion 54*d* and the second support portion 54*e* are formed by being bent substantially perpendicularly with respect to the main body 54*c* so that the first support portion 54*d* and the second support portion 54*e* extend in the same direction.

A first mounting portion 54*a* to be contacted to the mounting position of the rear window 32 is connected to the main body 54*c* through the first support portion 54*d*. The first mounting portion 54*a* is formed by being bent substantially perpendicularly with respect to the first support portion 54*d*. Thus, a crank shape is formed in which a flat surface of the first mounting portion 54*a* is located on the outside of a flat surface of the main body 54*c*, so that the flat surface of the first mounting portion 54*a* and the flat surface of the main body 54*c* extend substantially in the same direction. The first support portion 54*d* according to the present embodiment is connected to the first mounting portion 54*a* at a position shifted from a center line 58*a* of the first mounting portion 54*a*.

A second mounting portion 54*b* to be contacted to the mounting position of the rear window 32 is connected to the main body 54*c* through the second support portion 54*e*. The second mounting portion 54*b* is formed by being bent substantially perpendicularly with respect to the second support portion 54*e*. Thus, a crank shape is formed in which a flat surface of the second mounting portion 54*b* is located on the outside of the flat surface of the main body 54*c*, so that the flat surface of the second mounting portion 54*b* and the flat surface of the main body 54*c* extend substantially in the same direction. The second support portion 54*e* according to the present embodiment is connected to the second mounting portion 54*b* at a position shifted from a center line 58*b* of the second mounting portion 54*b*. A second engaging portion 52 for engaging the wire thereto is formed on the same side of the second support portion 54*e*. Note that, the first mounting portion 54*a* and the second mounting portion 54*b* each have a flat surface for mounting the coil device for antenna to the mounting position of the rear window 32, and the flat surface is also called as a "mounting surface".

Note that the mounting terminal 54 of the coil device for antenna 40*b* is bilaterally symmetrical with respect to the center lines 58*a*, 58*b* of the mounting terminal 54 of the coil device for antenna 40*a*. Namely, the mounting terminal 54 and the mounting terminal 44 (see FIG. 3) are in mirror symmetry to each other. Similar to the coil device for antenna 40*a*, it is possible to configure the coil device for antenna 40*b* capable of taking the first arrangement or the second arrangement by turning the connector terminal 43 by 180 degrees.

According to the first embodiment described above, the connector terminal 43 can be connected to the connector terminal connecting portion 45*a* having the direction thereof changed by 180 degrees. Conventionally, two sets of connector terminals, bases and coil portions corresponding to two different specifications are used for both mounting positions on both right and left end portions of the rear window 32. However, by using one set of the bilaterally symmetric connector terminal 43 and base 45 corresponding to one single specification, manufacturing cost can be remarkably reduced. Further, since the direction of the connector terminal 43 can be changed in accordance with the place for mounting the coil devices for antenna 40*a*, 40*b*, high degree of freedom in design can be achieved.

Further, since two coil patterns are provided corresponding to connecting direction of the connector terminal 43, the coil devices for antenna 40*a*, 40*b* can be easily configured even if the direction of the connector terminal 43 is changed by 180 degrees. Further, since turn numbers of the two coil patterns differ from each other by half turn, it is possible to perform fine adjustment of the inductance, and therefore the resonant frequency and inductance of the coil patterns can be flexibly adjusted according to different specifications and uses.

Figure 7:
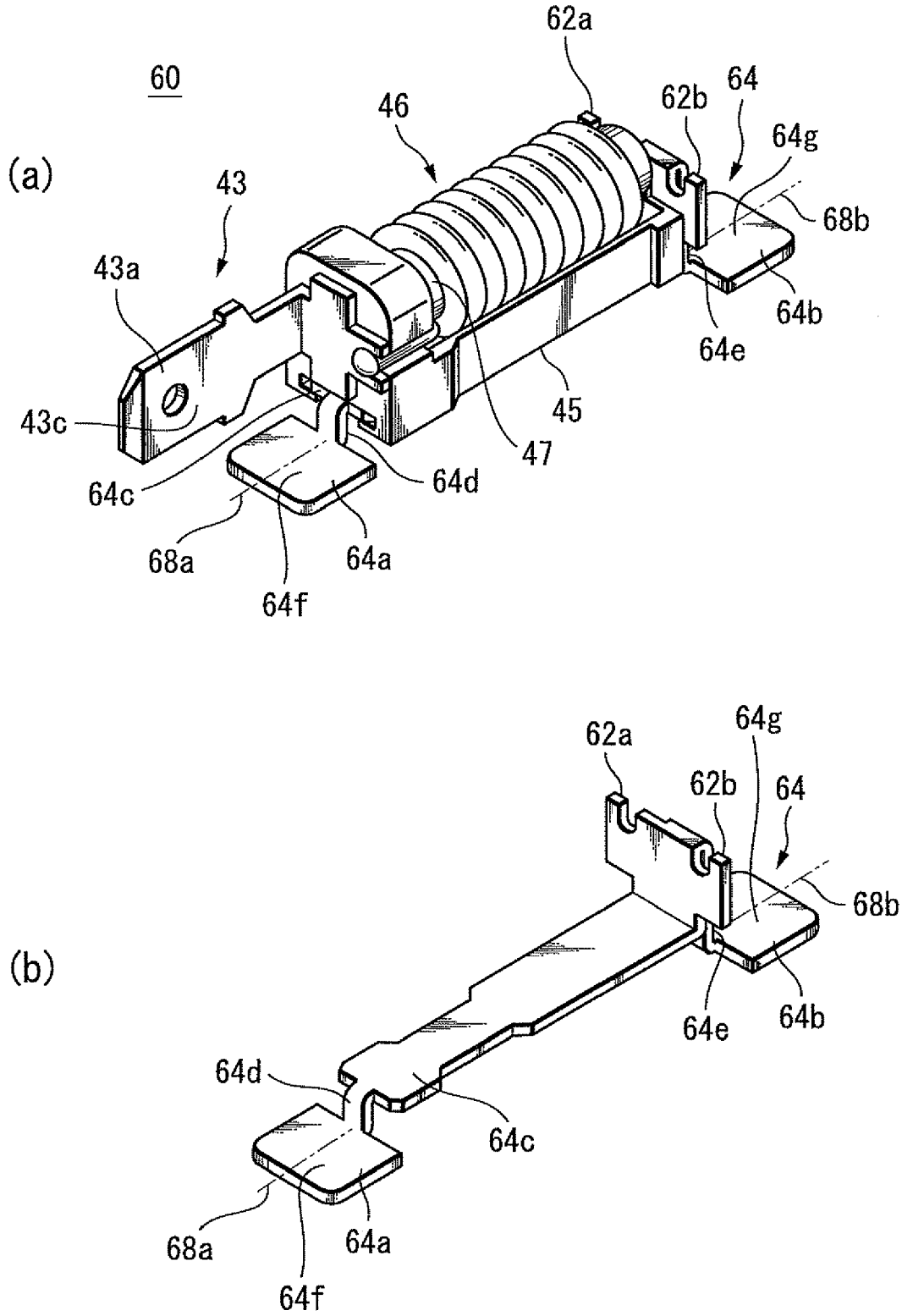
FIG. 7 is a perspective view showing an example of the coil device for antenna according to a second embodiment of the present invention.

A configuration example of a coil device for antenna 60 according to a second embodiment of the present invention will be described below with reference to FIG. 7. FIG. 7 is a perspective view showing the coil device for antenna 60 according to the second embodiment of the present invention.

FIG. 7(*a*) is a perspective view showing a configuration example of the coil device for antenna 60. As can be known from FIG. 7(*a*), the base 45 and a mounting terminal 64 of the coil device for antenna 60 are bilaterally symmetrical with respect to the winding axis of the coil portion 46. FIG. 7(*b*) is a perspective view showing a configuration example of the mounting terminal 64.

In the aforesaid first embodiment, the configuration example of the coil devices for antenna 40*a*, 40*b* respectively attached to the left side and right side of the bus bars in mirror symmetry to each other has been described. In the present embodiment, a mounting terminal 64 of the coil device for antenna 60 will be described below, the mounting terminal 64 being formed by deforming a part of the coil devices for antenna 40*a*, 40*b* so that the mounting terminal 64 is bilaterally symmetrical with respect to the winding axis of the coil portion. Note that, since the configuration example of the connector terminal 43, the base 45 and the coil portion 46 of the coil device for antenna 60 is identical to that of the coil devices for antenna 40*a*, 40*b*, like components are denoted by like numerals in the below description and the detailed explanation thereof will be omitted.

Since a configuration example of mounting the coil device for antenna 60 to the rear window 32 (FIG. 1) of the vehicle is identical to that of the coil device for antenna according to the aforesaid first embodiment, the detailed explanation thereof will be omitted in the present embodiment.

The coil device for antenna 60 is provided with a conductive mounting terminal 64 for mounting the coil device for antenna 60 to the right and left end portions of the rear window 32. The mounting terminal 64 is a terminal formed by punching and bending a flat conductive plate. The mounting terminal 64 is formed with a flat plate-like main body 64*c*. The base 45 formed of a non-conductive and non-magnetic resin is fixed to the main body 64*c* with an adhesive or the like. The coil portion 46 is fixed to the base 45 with an adhesive or the like, the coil portion 46 being formed by winding a wire around the cylindrical magnetic core 47 for a predetermined turns. The main body 64*c* is formed with, at both end portions thereof, a first support portion 64*d* and a second support portion 64*e*. The first support portion 64*d* and the second support portion 64*e* are formed by being bent substantially perpendicularly with respect to the main body 64*c* so that the first support portion 64*d* and the second support portion 64*e* extend in the same direction.

A first mounting portion 64*a* to be contacted to the mounting position of the rear window 32 is connected to the main body 64*c* through the first support portion 64*d*. The first mounting portion 64*a* is formed by being bent substantially perpendicularly with respect to the first support portion 64*d*. Thus, a crank shape is formed in which a flat surface of the first mounting portion 64*a* is located on the outside of a flat surface of the main body 64*c*, so that the flat surface of the first mounting portion 64*a* and the flat surface of the main body 64*c* extend substantially in the same direction. The first support portion 64*d* is connected to the first mounting portion 64*a* along an extension line of a center line 68*a* of the first mounting portion 64*a*. The center line 68*a* is coincident with the direction of the winding axis of the coil portion 46, and passes near the center of a wide surface 64*f* of the first mounting portion 64*a*. Similarly, a center line 68*b* is also coincident with the direction of the winding axis of the coil portion 46, and passes near the center of a wide surface 64*g* of the second mounting portion 64*b*. Further, the connector connecting section 43*a* is arranged so that the wide surface 43*c* thereof is perpendicular to the wide surface 64*f* of the first mounting portion 64*a*.

The second mounting portion 64*b* to be contacted to the mounting position of the rear window 32 is connected to the main body 64*c* through the second support portion 64*e*. The second mounting portion 64*b* is formed by being bent substantially perpendicularly with respect to the second support portion 64*e*. Thus, a crank shape is formed in which a flat surface of the second mounting portion 64*b* is located on the outside of the flat surface of the main body 64*c*, so that the flat surface of the second mounting portion 64*b* and the flat surface of the main body 64*c* extend substantially in the same direction. The second support portion 64*e* is connected along an extension line of the center line 68*b* of the second mounting portion 64*b*. In the present embodiment, two second engaging portions 62*a*, 62*b* for engaging the wire thereto is formed on the same side of the second support portion 64*e*. Note that, the first mounting portion 64*a* and the second mounting portion 64*b* are each provided with a flat surface for mounting the coil device for antenna to the mounting position of the rear window 32, and the flat surface is also called as a "mounting surface".

The coil device for antenna 60 according to the second embodiment also can be configured so as to taking the first arrangement or the second arrangement by turning the connector terminal 43 by 180 degrees. Further, the first coil pattern 46*a* and the second coil pattern 46*b* (see FIG. 4) can be applied to the coil portion 46.

According to the aforesaid second embodiment, it is possible to configure the coil device for antenna 60 which can be mounted no matter the mounting position is on the right side or on the left side. In the coil device for antenna 60, the connector terminal and the winding coil are formed in specific shapes, and by attaching the connector terminal having its direction changed by 180 degrees according to different specifications, two kinds of coil devices for antenna corresponding to two different specifications can be manufactured from one set of the connector terminal 43, the base 45, the coil portion 46 and the mounting terminal 64 corresponding to one single specification. Thus, it becomes unnecessary to prepare two kinds of dies and the like for producing two kinds of coil devices for antenna having shapes bilaterally symmetrical to each other (namely, two kinds of coil devices for antenna corresponding to two different specifications), manufacturing cost can be remarkably reduced. Further, since the configuration of each of these components is not complicated, the assembling of the coil device for antenna becomes further easy.

Figure 8:
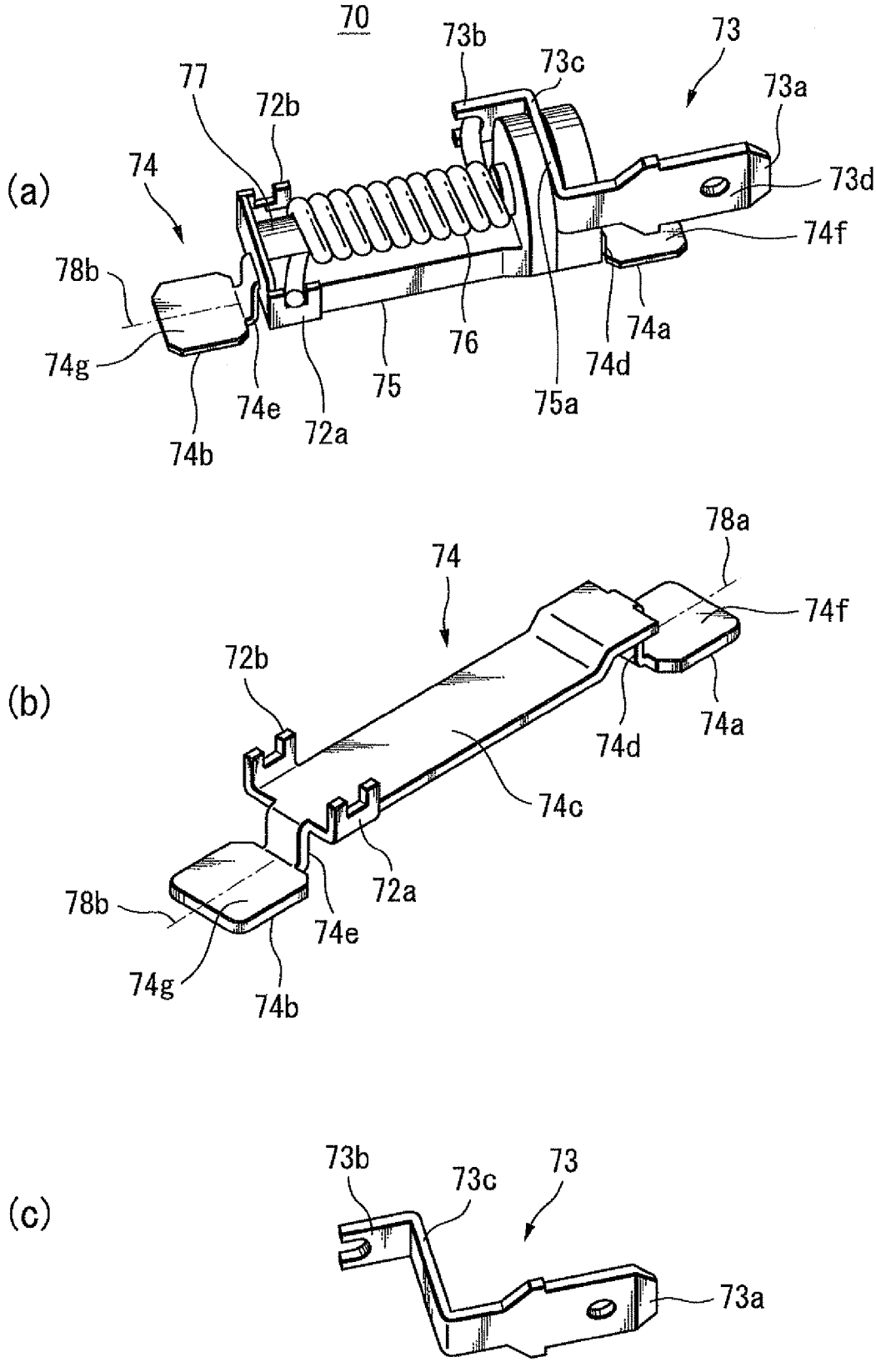
FIG. 8 is a perspective view showing an example of the coil device for antenna according to a third embodiment of the present invention.

A configuration example of a coil device for antenna 70 according to a third embodiment of the present invention will be described below with reference to FIG. 8. FIG. 8 is a perspective view showing a configuration example of the coil device for antenna 70 according to the third embodiment of the present invention. FIG. 8(*b*) is a perspective view showing a configuration example of a mounting terminal 74. FIG. 8(*c*) is a perspective view showing a configuration example of a connector terminal 73.

Since a configuration example of mounting the coil device for antenna 70 to the rear window 32 (see FIG. 1) of the vehicle is identical to that of the coil device for antenna according to the aforesaid first embodiment, the detailed explanation thereof will also be omitted when describing the present embodiment.

The coil device for antenna 70 is provided with the conductive mounting terminal 74 for mounting the coil device for antenna 70 to the right and left end portions of the rear window 32. The mounting terminal 74 is a terminal formed by punching and bending a flat conductive plate. The mounting terminal 74 is formed with a flat plate-like main body 74*c*. A base 75 formed of a non-conductive and non-magnetic resin is attached to the main body 74*c*. The main body 74*c* is formed with, at both end portions thereof, a first support portion 74*d* and a second support portion 74*e*. The first support portion 74*d* and the second support portion 74*e* are formed by being bent substantially perpendicularly with respect to the main body 74*c* so that the first support portion 74*d* and the second support portion 74*e* extend in the same direction.

A first mounting portion 74*a* to be contacted to the mounting position of the rear window 32 is connected to the main body 74*c* through the first support portion 74*d*. The first mounting portion 74*a* is formed by being bent substantially perpendicularly with respect to the first support portion 74*d*. Thus, a crank shape is formed in which a flat surface of the first mounting portion 74*a* is located on the outside of a flat surface of the main body 74*c*, so that the flat surface of the first mounting portion 74*a* and the flat surface of the main body 74*c* extend substantially in the same direction. The first support portion 74*d* is connected to the first mounting portion 74*a* along a center line 78*a* of the first mounting portion 74*a*. Here, the center line 78*a* is coincident with the direction of the winding axis of a coil portion 76, and passes near the center of a wide surface 74*f* of the first mounting portion 74*a*. Similarly, a center line 78*b* is also coincident with the direction of the winding axis of the coil portion 76, and passes near the center of a wide surface 74*g* of a second mounting portion 74*b*.

The second mounting portion 74*b* to be contacted to the mounting position of the rear window 32 is connected to the main body 74*c* through the second support portion 74*e*. The second mounting portion 74*b* is formed by being bent substantially perpendicularly with respect to the second support portion 74*e*. Thus, a crank shape is formed in which a flat surface of the second mounting portion 74*b* is located on the outside of the flat surface of the main body 74*c*, so that the flat surface of the second mounting portion 74*b* and the flat surface of the main body 74*c* extend substantially in the same direction. The second support portion 74*e* of the present embodiment is connected to the second mounting portion 74*b* along an extension line of the center line 78*b* of the second mounting portion 74*b*. Two second engaging portions 72*a*, 72*b* for engaging the wire thereto is formed on the same side of the second support portion 74*e*. Note that, the first mounting portion 74*a* and the second mounting portion 74*b* each have a flat surface for mounting the coil device for antenna to the mounting position of the rear window 32, and the flat surface is also called as a "mounting surface".

The base 75 is fixed to the main body 74*c* of the mounting terminal 74 with an adhesive or the like. The coil portion 76 is fixed to the base 75, the coil portion 76 being formed by winding a wire around a cylindrical magnetic core 77 for a predetermined turns. The base 75 is provided with a connector terminal connecting portion 75*a* at one end thereof, the connector terminal connecting portion 75*a* being provided for connecting the connector terminal 73 thereto. The connector terminal connecting portion 75*a* means a slit formed in the one end of the base 75. The connector terminal 73 is a terminal formed by punching and bending a flat conductive plate. The connector terminal 73 is configured by a connecting portion 73*c* formed by being bent substantially perpendicularly with respect to a connector connecting section 73*a*, and a first engaging portion 73*b* formed by being bent substantially perpendicularly with respect to the connecting portion 73*c*. The connector connecting section 73*a* is a terminal for connecting the external device thereto. Further, the first engaging portion 73*b* is provided for connecting one end of the wire wound around the coil portion 76 thereto. The connecting portion 73*c* is inserted into the connector terminal connecting portion 75*a* and fixed to the connector terminal connecting portion 75*a* with an adhesive or the like. Further, the connector connecting section 73*a* is arranged so that a wide surface 73*d* thereof is perpendicular to the wide surface 74*f* of the first mounting portion 74*a*.

The other end of the wire wound around the coil portion 76 is engaged to a second engaging portion 72*a*. In the present embodiment, the first coil pattern 46*a* described in the first embodiment is used as the coil pattern of the coil portion 76. Here, if the second coil pattern 46*b* described in the first embodiment is used as the coil pattern of the coil portion 76, the other end of the wire of the coil portion 76 shall be engaged to a second engaging portion 72*b*.

The coil device for antenna 70 according to the third embodiment also can be configured so as to taking the first arrangement or the second arrangement by turning the connector terminal 73 by 180 degrees. Further, the first coil pattern 46*a* and the second coil pattern 46*b* (see FIG. 4) can be applied to the coil portion 46.

Figure 10:
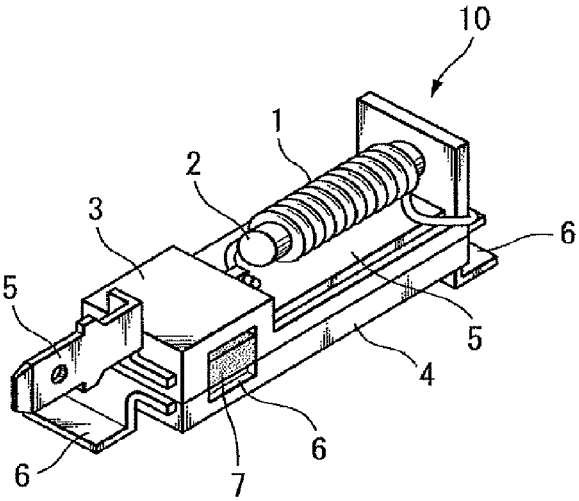
FIG. 10 PRIOR ART
FIG. 10 is a perspective view showing a configuration of an example of a choke coil according to a related art.
Figure 11:
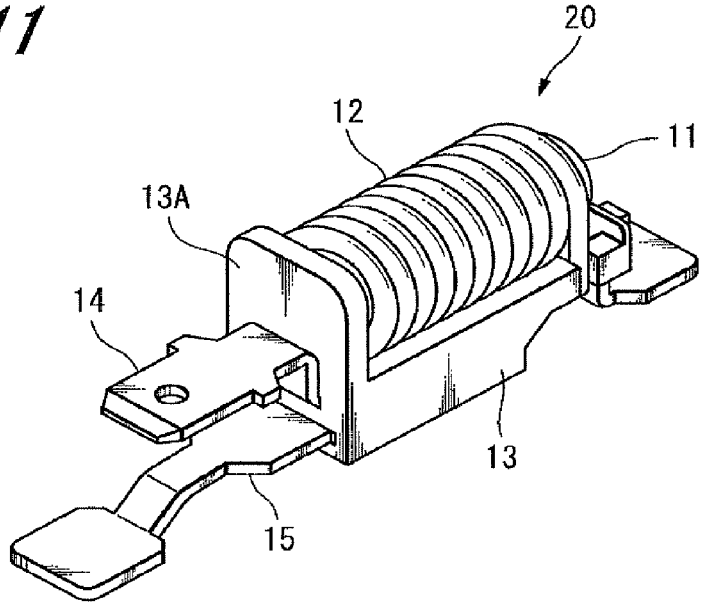
FIG. 11 is a perspective view showing a configuration of an example of the coil device for antenna according to another related art.

An example of stray capacitance component of the coil device for antenna 70 according to the present embodiment will be described below with reference to FIG. 9. Here, the affects of the stray capacitance component on the resonant frequency of the coil device for antenna will be discussed. FIG. 9 is a table showing a comparison of the stray capacitance component between a conventional choke coil 10 (see FIG. 10), a conventional coil device for antenna 20 (see FIG. 11) and the coil device for antenna 70 according to the present embodiment. Incidentally, the conventional choke coil 10 is called as a conventional coil device for antenna (1). Further, the conventional coil device for antenna 20 is called as a conventional coil device for antenna (2).

Generally, the resonant frequency depends on the inductance L and the capacitance C. Thus, when being used for purpose of effectively removing a noise having a specific frequency, unevenness of the inductance component (i.e., the inductance L of the winding coil) and the capacitance component (i.e., the stray capacitance component existed in the coil device for antenna and/or the capacitance component of capacitor(s) provided in the external structure) has to be strictly controlled.

The resonant frequency $f_0$ of the coil device for antenna is calculated by the following formula (1).

$$f_0=1/2\pi\sqrt{(L\times C)} \quad (1)$$

As can be known from formula (1), if C becomes high, the resonant frequency will shift toward low-frequency side. As a result, it becomes difficult to obtain a predetermined resonant frequency.

In the conventional coil device for antenna (1) disclosed in Patent Document 1, a tip end portion (the portion to be connected by a connector) of the metal terminal plate 5 is substantially perpendicular to a mounting surface of the metal plate 6. However, a part of the metal terminal plate 5 fitted into the base portion 3 faces the metal plate 6. For this reason, undesired stray capacitance component is generated, and therefore it becomes difficult to obtain a predetermined resonant frequency.

Further, in the conventional coil device for antenna (2) disclosed in Patent Document 2, the terminal board 14 and the terminal board 15 entirely face each other. Thus, similar to the choke coil 10 disclosed in Patent Document 1, undesired stray capacitance component is generated between the two terminal boards, and therefore it becomes difficult to obtain a predetermined resonant frequency.

In a condition that the coil portion of the conventional coil device for antenna (1), the coil portion of the conventional coil device for antenna (2) and the coil portion of the coil device for antenna 70 of the present embodiment all wound by the same turns of wire, and that the kind and diameter of the magnetic cores (around which the wires are wound) are the same, the inductances L of the respective coil devices for antenna are calculated to be 2.50 μH.

Further, the self-resonant frequency of the coil device for antenna is detected for respective coil devices for antenna. The result of the detection is: the self-resonant frequency of the conventional coil device for antenna (1) is 81.0 MHz, the self-resonant frequency of the conventional coil device for antenna (2) is 77.3 MHz, and the self-resonant frequency of the coil device for antenna 70 is 91.2 MHz.

The value of the stray capacitance component C can be calculated by substituting the above obtained inductance L and resonant frequency $f_0$ into formula (1). The result of the calculation is: the stray capacitance component C of the conventional coil device for antenna (1) is 1.54 pF, the stray capacitance component C of the conventional coil device for antenna (2) is 1.70 pF, and the stray capacitance component C of the coil device for antenna 70 is 1.22 pF.

As can be known by comparing the calculated stray capacitance components, the stray capacitance component of the conventional coil device for antenna (1) is higher than that of the coil device for antenna 70 by about 20%. Further, the stray capacitance component of the conventional coil device for antenna (2) is higher than that of the coil device for antenna 70 by about 40%. Thus, since the coil device for antenna 70 has the lowest stray capacitance component, a relatively high resonant frequency can be obtained.

According to the aforesaid third embodiment, it is possible to configure the coil device for antenna 70 which can be mounted no matter the mounting position is on the right side or on the left side. In the coil device for antenna 70, the connector terminal and the winding coil are formed in specific shapes, and by attaching the connector terminal having its direction turned by 180 degrees according to different specifications, two kinds of coil devices for antenna corresponding to two different specifications can be manufactured from one set of the connector terminal 73, the mounting terminal 74, the base 75 and the coil portion 76 corresponding to one single specification. Thus, it becomes unnecessary to prepare two kinds of dies for producing two kinds of coil devices for antenna having shapes bilaterally symmetrical to each other (namely, two kinds of coil devices for antenna corresponding to two different specifications), manufacturing cost can be remarkably reduced. Further, since the each of these components has no complicated configuration, the assembling of the coil device for antenna becomes further easy.

Further, since the wide surface 73*d* of the connector terminal 73 is substantially perpendicular to the wide surface 74*f* of the mounting terminal 74, the stray capacitance component generated between the two terminals can be remarkably reduced. Further, by remarkably reducing the stray capacitance component, uncertainties which lower the resonant frequency can be restrained.

According to the aforesaid the first, second and third embodiments, the configurations of the mounting terminal, the connector terminal and the base are simplified. Further, since two coil patterns are prepared, it becomes possible to flexibly adjust the resonant frequency and inductance according to different specifications and uses, and to easily obtain a desirable resonant frequency and inductance. Further, since it is possible to obtain a coil device for antenna having function of two specifications with one set of components corresponding to one single specification, manufacturing cost can be reduced.

Further, since the area where the mounting terminal and the connector terminal facing each other is reduced to a minimum, the stray capacitance component generated between the two terminals can be restrained. Thus, a desired resonant frequency can be easily obtained. Further, since the stray capacitance component generated between the two terminals is reduced, uncertainties which lower the resonant frequency can be restrained.

Note that, although the coil device for antenna according to the first, second and third embodiments is used for being mounted to the right and left end portions of the rear window herein, it obviously can be used for other purpose to obtain the same functions and advantages.

EXPLANATION OF REFERENCE NUMERALS

30 receiving system, 31 radio antenna wire, 32 rear window, 33*a*,33*b* bus bar, 34 battery, 35 TV antenna wire, 36,37 amplifier, 40*a*,40*b* coil device for antenna, 41 first engaging portion, 42 second engaging portion, 43 connector terminal, 43*a* connector connecting section, 43*b* base connecting portion, 44*a* first mounting portion, 44*b* second mounting portion, 44*c* main body, 44*d* first support portion, 44*e* second support portion, 45 base, 45*a* connector terminal connecting portion, 45*b* base connecting portion insertion hole, 46 coil portion, 46*a* first coil pattern, 46*b* second coil pattern, 47 magnetic core.

The invention claimed is:

1. A coil device for antenna comprising:

a winding coil;

a bar-like magnetic core inserted into the winding coil;

a connector terminal provided with a connector connecting section and a first engaging portion for engaging one end of the winding coil thereto;

a mounting terminal provided with a mounting portion having a mounting surface, and a second engaging portion for engaging the other end of the winding coil thereto; and a resin member to which the mounting terminal and the connector terminal are attached and on which the winding coil is mounted, the resin member having a recess for mounting the winding coil thereto and a projection to which the connector terminal is attached, wherein a main surface of the connector connecting section is perpendicular to the mounting surface of the mounting portion, wherein the connector terminal can take a first arrangement or a second arrangement relative to the projection of the resin member, where in the first arrangement, the connector connecting section is positioned at one end of the resin member and on one side in the width direction of the resin member and the first engaging portion is positioned on the other side in the width direction of the resin member, and in the second arrangement, the connector connecting section is positioned at the one end of the resin member and on the other side in the width direction of the resin member and the first engaging portion is positioned on the one side in the width direction of the resin member by turning the connector terminal in the first arrangement 180 degrees, and wherein the projection of the resin member has grooves on both sides thereof so that the one end of the winding coil is engaged with the first engaging portion of the connector terminal through either one of the grooves regardless of whether the connector terminal is in the first arrangement or in the second arrangement, each groove having a width and a depth that are substantially equal to a diameter of the winding coil, and the grooves formed in bilaterally symmetrical positions in a direction parallel to the mounting surface of the mounting portion of the mounting terminal so that a number of times the winding coil is turned differs by ½turn between when the connector terminal is in the first arrangement and when the connector terminal is in the second arrangement.

2. The coil device for antenna according to claim 1, wherein a line connecting a winding start point of the one end of the winding coil and a center point of a winding axis of the winding coil and a line connecting a winding end point of the other end of the winding coil and the center point of the winding axis of the winding coil are both substantially in parallel with the mounting surface of the mounting portion.

3. An antenna system for rear window of vehicle comprising a coil device for antenna according to claim 1 or 2.

* * * * *